US011385562B1

(12) United States Patent
Kurosawa

(10) Patent No.: US 11,385,562 B1
(45) Date of Patent: Jul. 12, 2022

(54) IMAGE FORMING APPARATUS AND POSITION CONTROL METHOD

(71) Applicant: TOSHIBA TEC KABUSHIKI KAISHA, Tokyo (JP)

(72) Inventor: Norio Kurosawa, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/189,742

(22) Filed: Mar. 2, 2021

(51) Int. Cl.
*G03G 15/043* (2006.01)
*G03G 15/00* (2006.01)
*G03G 15/04* (2006.01)

(52) U.S. Cl.
CPC ... *G03G 15/0435* (2013.01); *G03G 15/04072* (2013.01); *G03G 15/5062* (2013.01)

(58) Field of Classification Search
CPC ..... G03G 15/0435; G03G 15/04072; G03G 15/5062
See application file for complete search history.

(56) References Cited

U.S. PATENT DOCUMENTS

2009/0190944 A1* 7/2009 Okada ..... G06K 15/1214 399/51

FOREIGN PATENT DOCUMENTS

| | | | |
|---|---|---|---|
| JP | 2003-276233 | A | 9/2003 |
| JP | 2005-349748 | A | 12/2005 |
| JP | 2013-011746 | A | 1/2013 |

* cited by examiner

*Primary Examiner* — Walter L Lindsay, Jr.
*Assistant Examiner* — Geoffrey T Evans
(74) *Attorney, Agent, or Firm* — Kim & Stewart LLP

(57) ABSTRACT

According to one embodiment, an image reading apparatus includes an exposure unit, a light sensor, and a controller. The exposure unit selectively emits light to positions along a first scan direction to write pixels in accordance with a main scan line of image data. The light sensor is at a position to receive light from the exposure unit and is configured to output a synchronization signal according to the detection of the light emitted for each main scan line of image data. The controller adjusts a starting pixel position along the first scan direction for a main scan line of image data based on a change in an output interval of the synchronization signal resulting from a change in an intensity of light emitted by the exposure unit.

20 Claims, 9 Drawing Sheets

IMAGE FORMING APPARATUS AND POSITION CONTROL METHOD

FIELD

Embodiments described herein relate generally to an image forming apparatus and a position control method.

BACKGROUND

When forming an image on a sheet, the image forming apparatus scans the scanning area of a photoreceptor drum with a laser beam along the main scanning direction. The laser beam contains a signal in units of a pixel. Thus, the image forming apparatus forms a plurality of dots along the main scanning direction by scanning the laser beam through the scanning area from a dot start position to a dot end position. There may be cases where the positions of dots formed along the main scanning direction deviate from the reference or intended positions, thus there is a possibility that the position of the image on the sheet deviates from an expected or intended location. In order to prevent the position of the image from deviating, it is necessary to correct the positions of dots along the main scanning direction to be at appropriate positions.

In the related art, there is an image forming apparatus that detects a scanning laser beam with a sensor in order to prevent a deviation in the positions of dots along the main scanning direction. The image forming apparatus determines the timing for starting formation of the dots (dotting) along the main scanning direction based on a horizontal synchronization signal output from the sensor in response to the detection of the laser beam.

However, the reaction time of the sensor from the exposure by the laser beam to the actual output of the horizontal synchronization signal by the sensor may differ depending on the intensity of the laser beam. For example, different light intensities may be output according to the type of sheet being printed, the state of the photoreceptor drum deterioration, and the like. Thus, there may be a problem with deviation of the positions of dots along the main scanning direction from the reference positions if the laser beam output varies.

DETAILED DESCRIPTION

An image forming apparatus and a position control method are described. The apparatus and control method are capable of reducing deviations from intended dotting positions along a main scanning direction that might otherwise be caused by changes in the characteristics of a laser beam.

According to one embodiment, an image reading apparatus includes an exposure unit, a light sensor, and a controller. The exposure unit is configured to selectively emit light to positions along a first scan direction to write pixels in accordance with a main scan line of image data. The light sensor is at a position to receive light from the exposure unit and configured to output a synchronization signal according to the detection of the light emitted for each main scan line of image data. The controller is configured to adjust a starting pixel position along the first scan direction for a main scan line of image data based on a change in an output interval of the synchronization signal resulting from a change in an intensity of light emitted by the exposure unit.

An image forming apparatus and a position control method according to certain, non-limiting example embodiments will be described with reference to the drawings.

Figure 1:
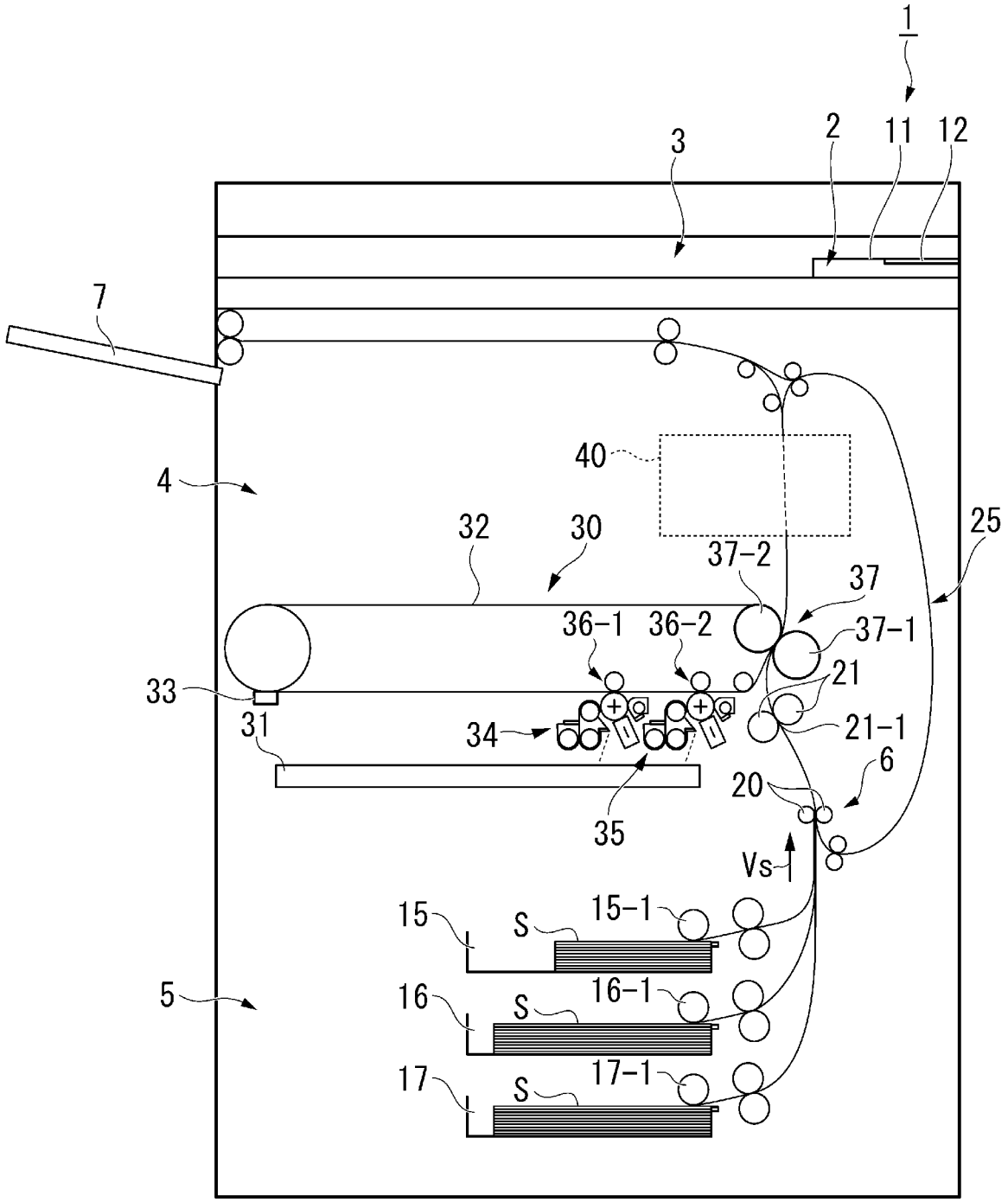
FIG. 1 is a diagram of an image forming apparatus according to an embodiment.

FIG. 1 is a diagram illustrating an example of an internal configuration of an image forming apparatus 1 according to the embodiment. The image forming apparatus 1 is an electrophotographic image forming apparatus. For example, the image forming apparatus 1 is a multi-function peripheral (MFP). The image forming apparatus 1 may be referred to as a printer or a copier in some instances. In the present embodiment, the case where the image forming apparatus 1 is a double-tandem type image forming apparatus will be described as an example, but the present disclosure is not limited to this type of image forming apparatus.

The image forming apparatus 1 can generate image data. The image data is digital data generated by reading an image from recording medium such as sheet of paper or the like or the image data may be provided to the image forming apparatus 1 from an external device. The image forming apparatus 1 forms an image corresponding to the image data on a sheet by using toner. For example, the sheet is paper, film, or the like. In general, the sheet may be made of any material as long as the image forming apparatus 1 can form an image on the sheet.

The image forming apparatus 1 includes an operation display unit 2, a scanner unit 3, a printing unit 4, a paper feeding unit 5, a conveying unit 6, and a paper ejecting unit 7.

The operation display unit 2 includes a display unit 11 and an operation unit 12.

The display unit 11 operates as an output interface and displays characters, text and images to a user. For example, the display unit 11 is a display device such as a liquid crystal display (LCD) or an organic Electro Luminescence (EL) display. The display unit 11 displays various information related to operations and functions of the image forming apparatus 1.

The operation unit 12 operates as an input interface for a user and receives inputs reflecting the instructions from the user. For example, the operation unit 12 includes a plurality of buttons, keys, switches, or the like. The operation unit 12 receives user input operations via the buttons and the like.

The display unit 11 and the operation unit 12 may be integrated with each other as a touch panel display or the like. For example, the operation display unit 2 may be a touch panel type liquid crystal display. That is, the operation display unit 2 may operate as both an output device and an input device.

In a case where the operation mode of the image forming apparatus 1 is a scan (scanner) mode, the scanner unit 3 reads image information from an object to be scanned. The scanner unit 3 comprises, for example, a contact image sensor (CIS), a charge coupled device (CCD), or the like. The scanner unit 3 reads an image from a sheet, document, or other object by using a sensor to generate image data.

In a case where the operation mode of the image forming apparatus 1 is a copy (copier) mode, the printing unit 4 prints images on sheets based on the image data generated by the scanner unit 3. In other operation modes, the printing unit 4 may print images based on image data acquired from another information processing apparatus (an external device) via a network or the like. The printing unit 4 forms an image on a sheet with toner. A sheet with an image formed thereon may be referred to as a hard copy, a printout, or the like.

As non-limiting examples of toner, a decolorable toner, a non-decolorable toner ("normal toner"), or a decorative toner ("specialty toner") are described. The decolorable toner can be decolorized by an external stimulus, such as heat, light of a specific wavelength, or pressure. In this context "decolorized" or "decolorable" refers to an image or material that changes from an initial, printed color to either become a different color matching a base color of the paper on which the image was printed or otherwise substantially visually undetectable with an unaided eye. External stimuli which might be utilized for decolorizing decolorable images are temperature changes, exposure to light of a specific wavelength, and pressure changes, or combinations of such stimuli.

As a decolorable toner, any toner may be used as long as the toner has the above-described characteristics. For example, a colorant of the decolorable toner may be a leuco dye. The decolorable toner may be appropriately combined with a color developing agent, a decolorizing agent, a discoloration temperature adjusting agent, and the like.

The paper feeding unit 5 supplies the sheets to the printing unit 4. The paper feeding unit 5 supplies sheets one by one to the printing unit 4 in accordance with a timing at which the printing unit 4 forms the toner image. The paper feeding unit 5 includes paper feeding cassettes 15, 16, and 17. Each of the paper feeding cassettes 15, 16, and 17 stores sheets of a predetermined size and type. In this context, a sheet type may be based, for example, on sheet thickness, such that plain paper is one type and thick paper is another type.

The paper feeding cassettes 15, 16, and 17 include pickup rollers 15-1, 16-1, and 17-1, respectively. The pickup rollers 15-1, 16-1, and 17-1 respectively take out a sheet from the paper feeding cassettes 15, 16, and 17. The pickup rollers 15-1, 16-1, and 17-1 supply the taken-out sheets to the conveying unit 6.

Sheets specifically for forming decolorable images may be stored in anyone of the plurality of paper feeding cassettes 15, 16, and 17. In some examples, since an image of a sheet formed with the decolorable toner may be later decolorized, the sheet may be reused after the decolorization processing of the previously printed sheet in a decolorizing mode. Thus, it is possible to reuse such a sheet a plurality of times.

The conveying unit 6 transports the sheet between various portions of the image forming apparatus 1. In the following description, since the sheets are conveyed from the paper feeding unit 5 to the paper ejecting unit 7, points along the sheet conveyance path that are closer to the paper feeding unit 5 (may be referred to as "on the paper feeding unit 5 side" are referred to as being on an upstream side along a sheet conveyance direction Vs of the sheet conveyance path, and points along the sheet conveyance path that are closer to the paper ejecting unit 7 (may be referred to as "on the paper ejecting unit 7 side") are referred to as being on a downstream side along the sheet conveyance direction Vs of the sheet conveyance path.

The conveying unit 6 includes a pair of conveying rollers 20 and a pair of registration rollers 21.

The conveying roller 20 conveys the sheets supplied from the pickup rollers 15-1, 16-1, and 17-1 to the registration roller 21. The conveying roller 20 abuts the downstream end of the sheet ("leading edge") against the nip 21-1 of the registration rollers 21. The conveying roller 20 thus adjusts the position of the downstream end of the sheet.

The registration roller 21 temporarily stops the sheet being conveyed by the conveying roller 20. The registration roller 21 then sends the sheet toward a secondary transfer unit 37 in accordance with the timing at which the toner image is formed on an intermediate transfer body 32. The toner image on the intermediate transfer body 32 is transferred to the sheet by the secondary transfer unit 37. The registration rollers 21 face each other along a conveying path between the conveying roller 20 and the secondary transfer unit 37. A nip 21-1 is formed between the pair of registration rollers 21.

The registration roller 21 aligns the downstream ends of each sheet sent from the conveying roller 20 at the nip 21-1, and after that the alignment, conveys the sheet along to the secondary transfer unit 37 side.

A reversing unit 25 reverses the sheets after fixing unit 40 by a switchback operation. The reversing unit 25 conveys the reversed sheet back to the front of the registration roller 21 again. The reversing unit 25 reverses the sheet so a toner image can be formed on the back surface of a sheet. Thus, double-sided printing can be performed on sheets.

Figure 2:
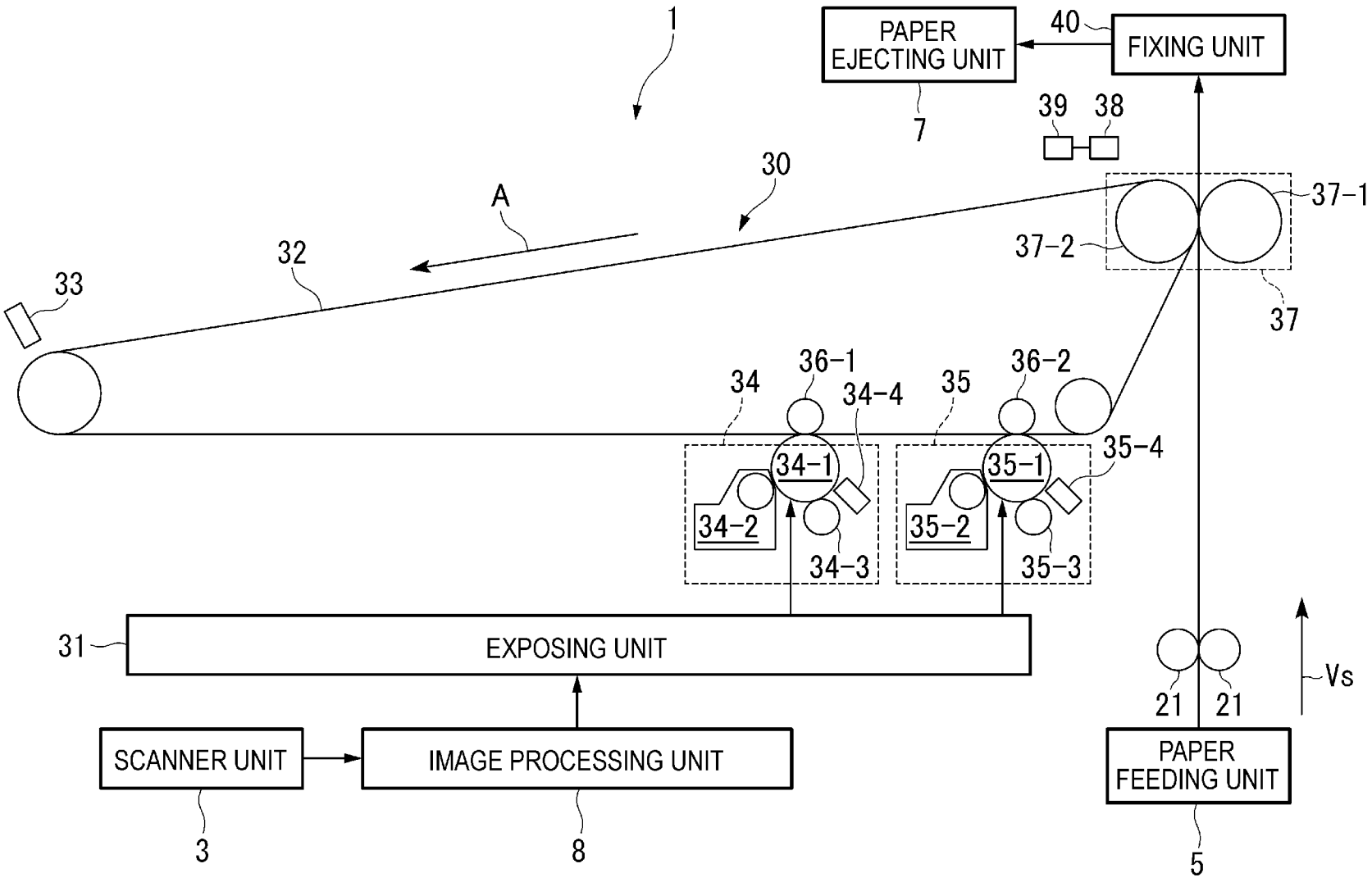
FIG. 2 is a schematic configuration of an image forming apparatus according to an embodiment.

The printing unit 4 is illustrated in more detail in FIG. 2. FIG. 2 is a diagram illustrating one example of the schematic configuration of image forming apparatus 1 according to the embodiment.

The printing unit 4 includes a transfer unit 30 and a fixing unit 40.

The transfer unit 30 includes an exposing unit 31, the intermediate transfer body 32, a cleaning blade 33, image generating units 34 and 35, primary transfer rollers 36-1 and 36-2, a secondary transfer unit 37, a temperature detection unit 38, and a temperature adjustment unit 39.

The temperature detection unit 38 detects the temperature around the secondary transfer unit 37. For example, the temperature detection unit 38 is a temperature sensor.

The temperature adjustment unit 39 functions to adjust the temperature around the secondary transfer unit 37 based on the detection result of the temperature detection unit 38. For example, the temperature adjustment unit 39 is a fan. The temperature adjustment unit 39 may have more functions and purpose beyond just adjusting the temperature around the secondary transfer unit 37. For example, the temperature adjustment unit 39 may function for the purpose of ejecting or venting ozone from the image forming apparatus.

The image transfer process in the image forming apparatus 1 includes a first transfer step and a second transfer step.

In the first transfer step, the primary transfer rollers 36-1 and 36-2 can each transfer a toner image from respective photoreceptor drums 34-1 and 35-1 to the intermediate transfer body 32.

In the second transfer step, the secondary transfer unit 37 transfers the toner images formed on the intermediate transfer body 32 to the sheet. In general, the toner images from each of the generating units 34 and 35 are stacked one upon the other on the intermediate transfer body 32 before being transferred together to the sheet at the secondary transfer unit 37.

The scanner unit 3 reads an image from a sheet, document, or object to be scanned. For example, the scanner unit 3 reads a color image on a sheet and the generates image data corresponding to scanned color image. The scanner unit 3 outputs the generated image data to an image processing unit 8.

The image processing unit 8 controls the exposing unit 31 based on a color signals corresponding to the image data from the scanner unit 3.

The exposing unit 31 irradiates the photoreceptor drums 34-1 and 35-1 of the image generating units 34 and 35 with light (exposure) according to respective color signals.

The intermediate transfer body 32 rotates in the direction of an arrow A of FIG. 2. The intermediate transfer body 32 may be a belt. A toner image is formed on the surface of the intermediate transfer body 32.

The cleaning blade 33 removes the toner still attached to the intermediate transfer body 32 after the secondary transfer process. The cleaning blade 33 is, for example, a plate-shaped member. In some examples, cleaning blade 33 is made of a resin such as urethane resin. The tip of the cleaning blade 33 presses against the intermediate transfer body 32 to scrape off toner from the intermediate transfer body 32. Instead of, or in addition to, a cleaning blade 33, a charged brush may be brought into contact with the intermediate transfer body 32.

The image generating units 34 and 35 form images using toner of different respective colors or types. The image generating units 34 and 35 are provided along the intermediate transfer body 32 in series. Image generating unit 34 is before the image generating unit 35 in the present example.

In the present example, image generating unit 34 utilizes a decolorable toner. The image generating unit 34 (referred to in this context as "decolorized image generating unit 34") contains the decolorable toner and thus transfers a decolorable toner image to the intermediate transfer body 32. In the present example, the decolorable toner has a blue color when initially fixed to a sheet.

The image generating unit 35 is downstream of the decolorized image generating unit 34 along the rotation direction A of the intermediate transfer body 32. The image generating unit 35 utilizes a non-decolorable toner 32. In the embodiment, the image generating unit 35 (referred to in this context as "non-decolorized image generating unit 35") contains a non-decolorable black toner.

The image forming apparatus 1 of this example executes printing in the following two modes:

- Monochrome toner mode (An image is formed with non-decolorable toner)
- Decolorable toner mode (An image is formed with decolorable toner).

The mode can be selected by the user of the image forming apparatus 1.

In the monochrome toner mode, an image is formed by operation of the non-decolorized image generating unit 35 using of black non-decolorable toner. The monochrome toner mode can be selected if the user desires to print a general monochrome image. For example, this mode is used if important materials are to be printed without reusing paper.

In the decolorable toner mode, an image is formed by operating just the decolorized image generating unit 34 using the decolorable toner. The decolorable toner mode can be selected if the paper is to be reused at a later time.

The decolorized image generating unit 34 and the non-decolorized image generating unit 35 have generally the same configuration although different toners are contained therein. Therefore, the decolorized image generating unit 34 will be particularly described as a representative example of both the image generating units 34 and 35.

The decolorized image generating unit 34 includes a photoreceptor drum 34-1, a developer 34-2, a charger 34-3, and a cleaning blade 34-4.

The photoreceptor drum 34-1 is one type of image carrier. The photoreceptor drum 34-1 has a photoreceptor on the outer peripheral surface. For example, the photoreceptor is an organic photoconductor (OPC).

The developer 34-2 contains a developing agent. The developer includes toner. The developer 34-2 supplies toner to the photoreceptor drum 34-1. For example, the toner is used as a one-component developing agent or as a two-component developing agent in combination with a carrier. For example, as a carrier, iron powder or polymer ferrite particles having a particle size of several tens of microns are used. In the present embodiment, a two-component developing agent containing a non-magnetic toner is used.

The charger 34-3 uniformly charges the surface of the photoreceptor drum 34-1.

The cleaning blade 34-4 removes toner attached to the photoreceptor drum 34-1.

The outline of the operation of the decolorized image generating unit 34 will be described.

The photoreceptor drum 34-1 is charged to a predetermined potential by the charger 34-3. Next, the exposing unit 31 selectively irradiates the photoreceptor drum 34-1 with light (e.g., a laser beam). The electrostatic potential of the area irradiated with light in the photoreceptor drum 34-1 changes. An electrostatic latent image is formed on the surface of the photoreceptor drum 34-1 as a result of the selective irradiation. The electrostatic latent image on the surface of the photoreceptor drum 34-1 is then developed with the developing agent of the developer 34-2. That is, a developed image formed toner is on the surface of the photoreceptor drum 34-1.

The developed image formed on the surface of the photoreceptor drum 34-1 is then transferred to the intermediate transfer body 32 by the primary transfer roller 36-1 facing the photoreceptor drum 34-1.

An image is formed by using only the decolorable toner in this example. That is, by the operation of the decolorized image generating unit 34, a decolorable toner image is formed on the intermediate transfer body 32.

If just the non-decolorized image generating unit 35 operates, a non-decolorable toner image is formed on the intermediate transfer body 32.

The non-decolorized image generating unit 35 includes a photoreceptor drum 35-1, a developer 35-2, a charger 35-3, and a cleaning blade 35-4.

The respective one of the primary transfer rollers 36-1 or 36-2 is used for transferring the toner image formed by the image generating units 34 and 35 to the intermediate transfer body 32.

The second transfer step will be described.

The secondary transfer unit 37 includes a secondary transfer roller 37-1 and a facing secondary transfer roller 37-2. In the secondary transfer unit 37, the intermediate transfer body 32 and the secondary transfer roller 37-1 are in contact with each other. For rectifying paper jams and the like, the intermediate transfer body 32 and the secondary transfer roller 37-1 may be configured to be separable from each other.

A bias voltage is applied to the secondary transfer roller 37-2. Thus, an electric field is generated between the secondary transfer roller 37-2 and the secondary transfer roller 37-1. With this electric field, the secondary transfer unit 37 transfers the toner image formed on the intermediate transfer body 32 to the sheet. The sheet is then guided to the fixing unit 40.

The fixing unit 40 can be controlled to be in a fixing mode or a decolorizing mode. In the fixing mode, the toner image is fixed to the sheet. In the decolorizing mode, the toner image is decolorized. The fixing unit 40 fixes the toner image to the sheet by heat and pressure. For example, the fixing unit 40 includes a heated roller (heating unit) and a pressuring unit. After the fixing unit 40 the sheet can be ejected from the paper ejecting unit 7 to the outside of the image forming apparatus 1.

Figure 3:
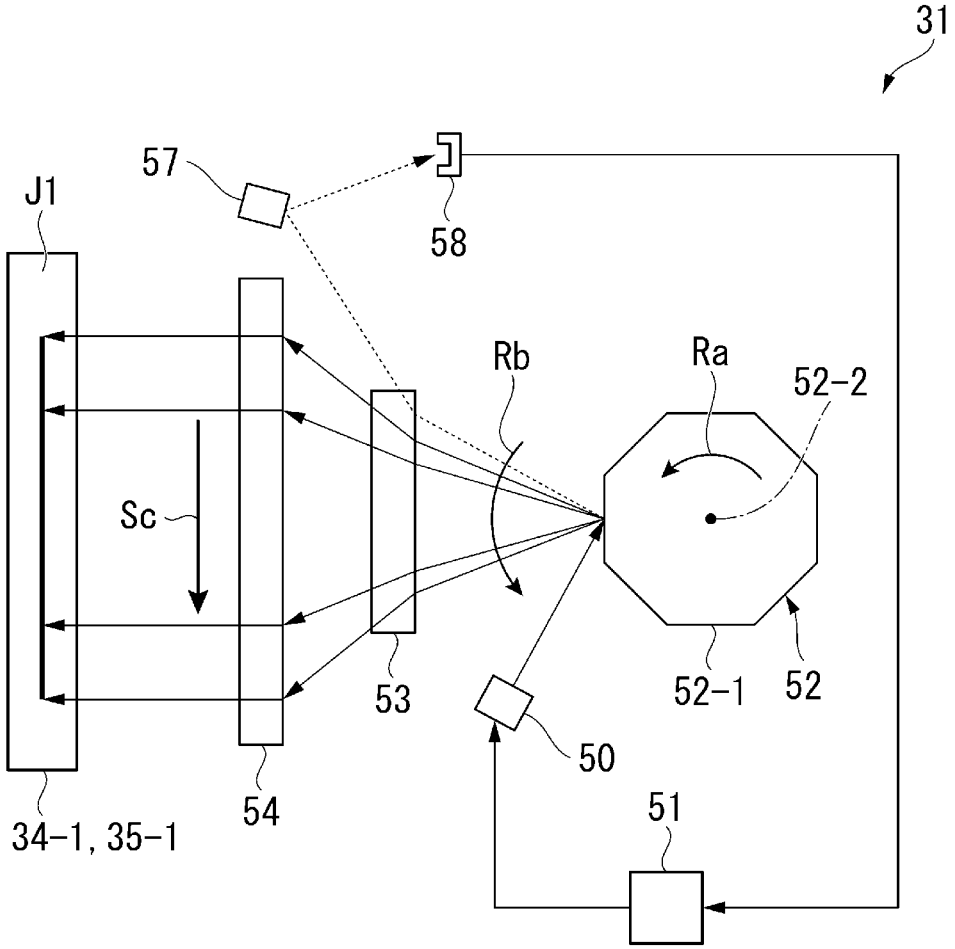
FIG. 3 is a schematic configuration of an exposing unit.

The exposing unit 31 of the printing unit 4 will be described. FIG. 3 is a plan view illustrating an example of a schematic configuration of the exposing unit 31 according to the present embodiment.

The exposing unit 31 includes a light source 50, a light control circuit 51, a light deflection unit 52, a first imaging lens 53, a second imaging lens 54, an optical path changing unit 55, an optical path changing unit 56, a mirror 57, and a sensor 58.

The light source 50 in this example is a Laser Diode (LD) that emits a laser beam (light). In other examples, the light source 50 may be a Light Emitting Diode (LED).

The light control circuit 51 includes a laser driver that causes the light source 50 to emit light. The light source 50 outputs an optically-modulated laser beam based on an optical modulation signal by the control of the light control circuit 51. For example, the optical modulation signal is generated based on an image data signal and a horizontal synchronization signal. The laser beam emitted from the light source 50 can be supplied to a collimator lens then be incident on the reflecting surfaces of the polygon mirror 52-1.

The light deflection unit 52 in this example includes a regular polyhedral polygon mirror 52-1 having a reflecting surface formed on each side of the regular polyhedron. The polygon mirror 52-1 is rotated around the rotation axis 52-2 by the motor 52-3. The polygon mirror 52-1 rotates in the direction of an arrow Ra at a steady angular velocity and deflects the laser beam at each reflecting surface generally increasing the direction of arrow Rb as the polygon mirror 52-1 rotates. It is generally preferable that the polygon mirror 52-1 rotates at constant angular velocity.

The polygon mirror 52-1 continuously reflects the laser beam output from the light source 50 at positions along the axial directions of the photoreceptor drums 34-1 and 35-1. The polygon mirror 52-1 continuously reflects the laser beams from the light source 50 in a direction paralleling the scanning lines during reading the image by the scanner unit 3. The laser beams reflected by the polygon mirror 52-1 pass through the first imaging lens 53 and the second imaging lens 54, and at the exposure position on the photoreceptor drums 34-1 and 35-1, the photoreceptor drums 34-1 and 35-1 are sequentially irradiated at positions along the axial directions.

The first imaging lens 53 and the second imaging lens 54 provide predetermined optical characteristics to the laser beam reflected by the polygon mirror 52-1. The first imaging lens 53 and the second imaging lens 54 extend in the axial directions of the photoreceptor drums 34-1 and 35-1. The first imaging lens 53 and the second imaging lens 54 help form an image on the photoreceptor drums 34-1 and 35-1 so that the relationship between the rotation angle of the polygon mirror 52-1 and the focal length satisfies an image height requirement. The first imaging lens 53 and the second imaging lens 54 cooperate with a cylindrical lens or the like to provide convergence to the laser beam reflected by the polygon mirror 52-1.

The rotational axis of the photoreceptor drums 34-1 and 35-1 is parallel to the main scanning direction in the image formation process. The surfaces of the photoreceptor drums 34-1 and 35-1 are scanned along the main scanning direction with the laser beam reflected by the polygon mirror 52-1. Reference numeral "Sc" in FIG. 3 denotes the main scanning direction. The main scanning direction Sc is a direction parallel to the rotational axis. The sub-scanning direction is a direction perpendicular to the main scanning direction and thus corresponds to a circumferential direction of the photoreceptor drums 34-1 and 35-1.

Figure 4:
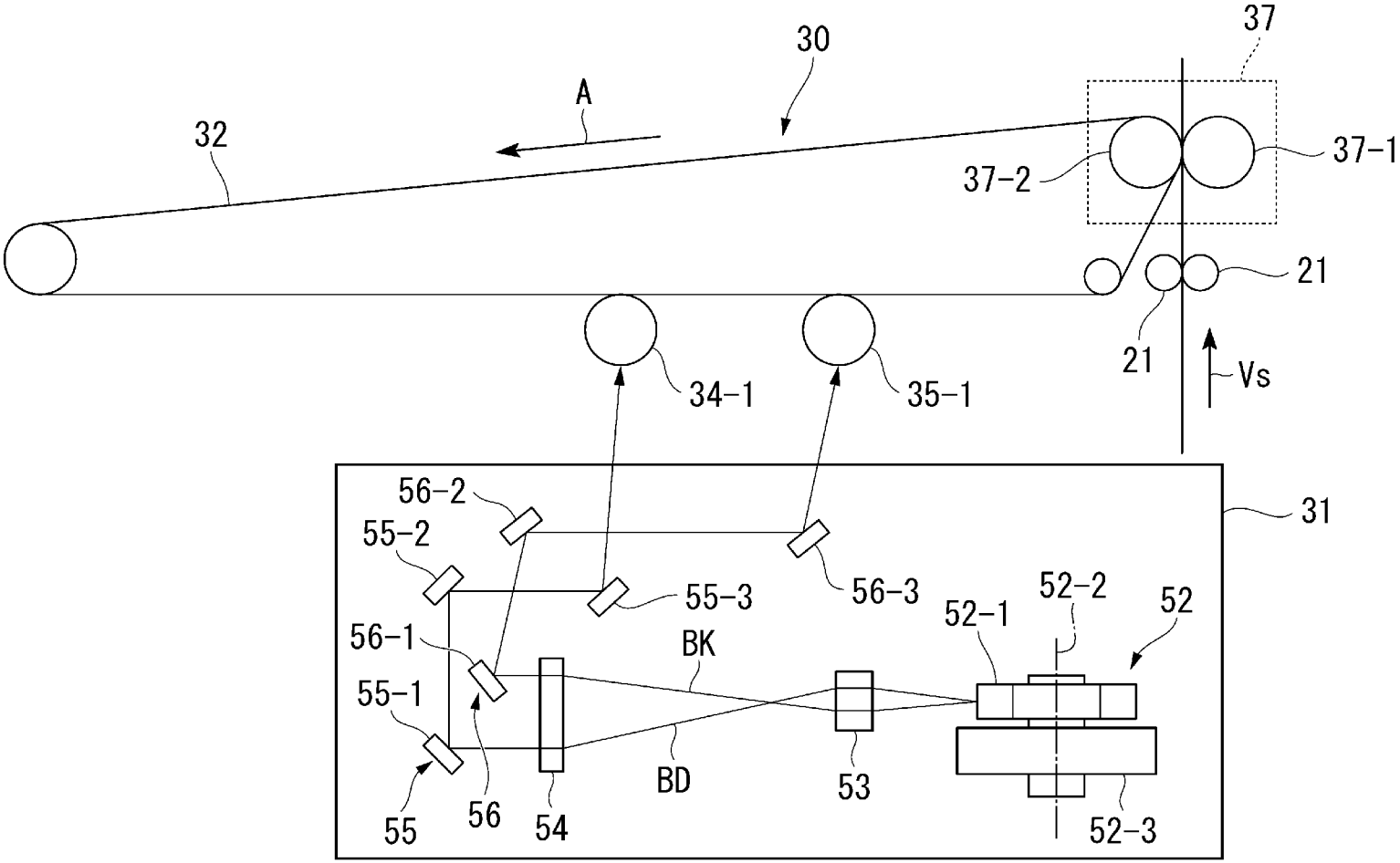
FIG. 4 is a schematic configuration of a printing unit.

As depicted in FIG. 4, the optical path changing units 55 and 56 are arranged between the second imaging lens 54 and the photoreceptor drums 34-1 and 35-1.

The optical path changing unit 55 directs a decolorizing image laser beam BD that passes through the second imaging lens 54 toward the photoreceptor drum 34-1. The optical path changing unit 55 includes a plurality of mirrors 55-1, 55-2, and 55-3. The laser beam BD that passes through the second imaging lens 54 is reflected by the mirrors 55-1, 55-2, and 55-3 in this order so as to be incident on the photoreceptor drum 34-1.

The optical path changing unit 56 directs a non-decolorizing image laser beam BK that passes through the second imaging lens 54 toward the photoreceptor drum 35-1. The optical path changing unit 56 includes a plurality of mirrors 56-1, 56-2, and 56-3. The laser beam BK that passes through the second imaging lens 54 is reflected by the mirrors 56-1, 56-2, and 56-3 in this order so as to be incident on the photoreceptor drum 35-1.

As depicted in FIG. 3, mirror 57 reflects light that passes through the first imaging lens 53 toward the sensor 58.

The sensor 58 is arranged in an area away from the photoreceptor drums 34-1 and 35-1. For example, the sensor 58 is positioned to receive light from near the starting edge side in the main scanning direction Sc. In other words, the sensor 58 receives light from a laser beam near the beginning of a scan in the main scanning direction Sc. The sensor 58 detects the laser beam with which scanning area J1 will be scanned in order to synchronize the start timing of dot formation along the main scanning direction Sc.

In this context, the scanning area J1 denotes the area on the surface of the photoreceptor drums 34-1 and 35-1, which is scanned with the laser beam during the latent image formation process involving selective exposure of particular dot locations (image pixels) along the main scanning direction Sc according to the image data. The scanning start position in this context refers to the starting edge position of the scanning area J1 along the main scanning direction Sc. The scanning start position is located at the starting edge of a scanning line. The scanning end position in this context refers to the ending edge position opposite to the scanning start position in the main scanning direction Sc. The scanning end position is located at the ending edge of a main scanning line formed in the scanning area J1.

The sensor 58 is a horizontal synchronization sensor in this example. The sensor 58 supplies a horizontal synchronization signal to the light control circuit 51. The horizontal synchronization signal is used for a switching timing of each line formed in the scanning area J1. The horizontal synchronization signal can be used as a signal that indicates the end of a scanning of one line and the start of a scanning of another line (the next line).

The light control circuit 51 determines the time to start outputting the image data for each line based on the detection result of the sensor 58. Specifically, the time is the dotting start time for dots along the main scanning direction Sc.

Figure 5:
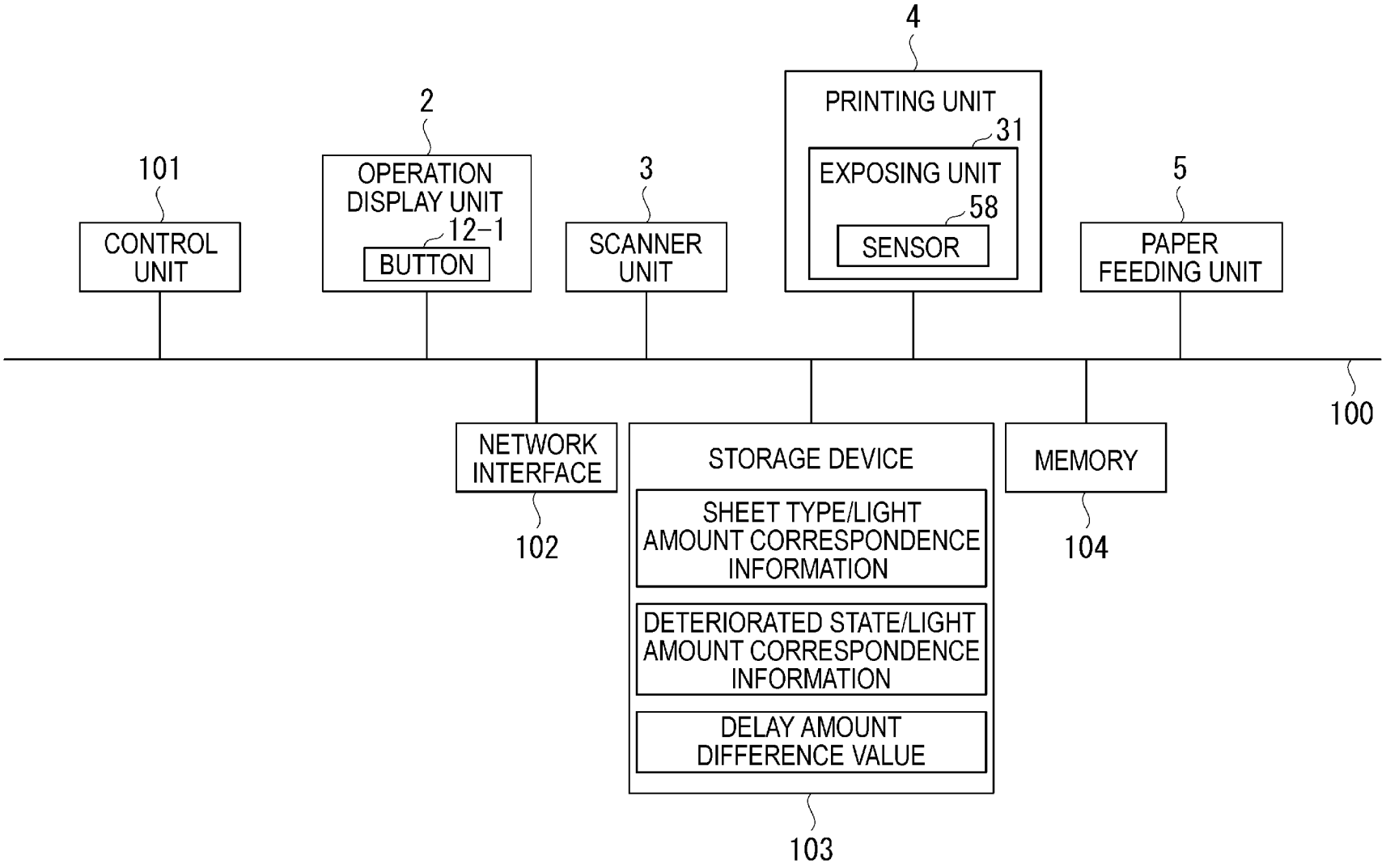
FIG. 5 is a block diagram of an image forming apparatus according to an embodiment.

FIG. 5 is a block diagram illustrating an example of the functional configuration of the image forming apparatus 1 according to an embodiment. Each functional unit of the image forming apparatus 1 is connected via a system bus 100.

The control unit 101 controls the operation of each functional unit of the image forming apparatus 1. The control unit 101 executes various processes by executing a software program or the like. The program can be recorded in advance in, for example, the storage device 103. The program may be recorded in advance in the memory 104 or an external recording medium or the like. The control unit 101 acquires the instructions input by the user via the operation display unit 2. The control unit 101 executes a control process based on the acquired instruction(s).

For example, the control unit 101 can control the rotation speed of the secondary transfer roller 37-1.

The control unit 101 may increase the temperature of the fixing unit 40 to switch to decolorizing mode from the fixing mode. That is, the control unit 101 operates the fixing unit 40 to be at two or more target temperatures. Specifically, the memory 104 stores two target temperatures (set points) for the fixing unit 40. The control unit 101 loads the target temperature from the memory 104 according to the selected mode and operates the fixing unit 40 according to the target temperature. A first temperature is a temperature target in the decolorizing mode. A second temperature is a temperature target in the fixing mode. The second temperature is lower than the first temperature.

Figure 6:
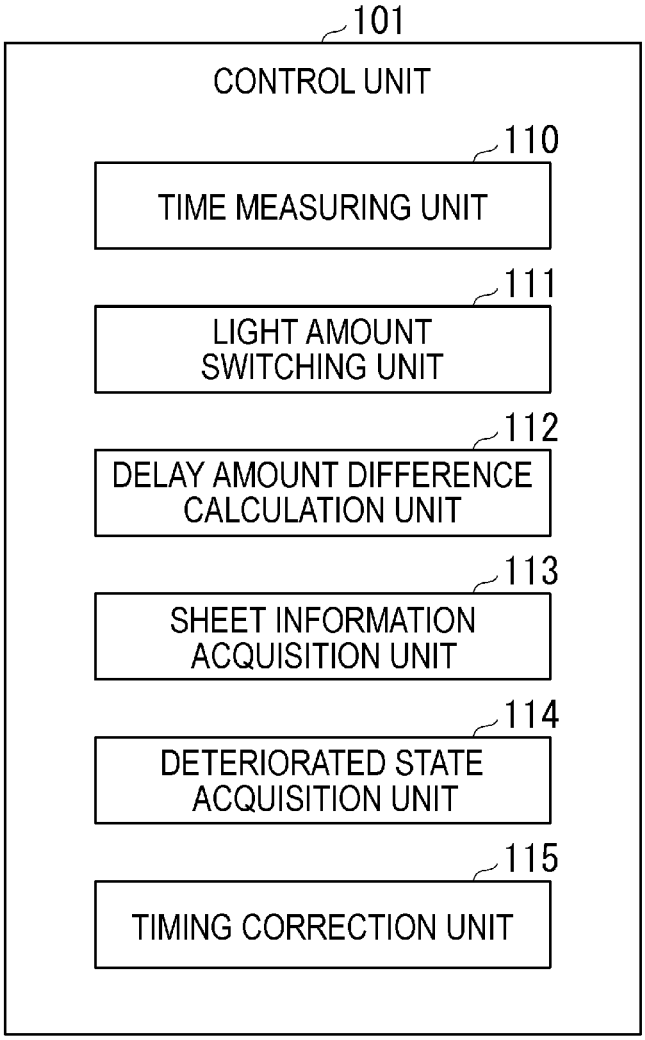
FIG. 6 is a block diagram of a control unit.

FIG. 6 is a block diagram illustrating an example of the functional configuration of the control unit 101 according to an embodiment.

The control unit 101 includes a time measuring unit 110, a light amount switching unit 111, a delay amount difference calculation unit 112, a sheet information acquisition unit 113, a deteriorated state acquisition unit 114, and a timing correction unit 115.

The time measuring unit 110 measures the interval at which the horizontal synchronization signal output from the sensor 58 is sent to the light control circuit 51. The time measuring unit 110 measures the interval with a counter that counts, for example, the number of internal clock cycles.

The light amount switching unit 111 switches the power output of the laser beam from the light source 50. In the present embodiment, the light amount switching unit 111 switches between a first light amount setting and a second light amount setting. The second light amount setting results in a laser beam that has less power (intensity) than the laser beam at the first light amount setting. The light supplied at first light amount setting is referred to as a "normal light amount," and the light supplied at the second light amount setting is referred to as a "dimmed light amount". In the present embodiment, the light amount switching unit 111 is configured to switch to between two different light amount settings, but in other examples the light amount switching unit 111 may be configured to switch between three or more light amount settings.

The delay amount difference calculation unit 112 calculates the difference (hereinafter, referred to as a "delay amount difference value") between the delay amount when the laser beam is a normal light amount and the delay amount when the laser beam is a dimmed light amount. The delay amount referred to herein is the time from when the laser beam is first incident on the sensor 58 to when the sensor 58 subsequently outputs the horizontal synchronization signal to the light control circuit 51. The delay amount difference calculation unit 112 records the calculated delay amount difference value in the storage device 103.

The sheet information acquisition unit 113 acquires information ("sheet information") indicating the type of sheet on which image formation will be performed. The type of sheet relevant in this context is, for example, whether the sheet is plain paper or thick paper. The sheet information can be generated, for example, when the user performs an operation with the operation unit 12 for selecting the type of sheet.

The deteriorated state acquisition unit 114 acquires information indicating the deteriorated state of the photoreceptor drums 34-1 and 35-1. The deterioration referred to here is, for example, increased difficulty in changing the photoreceptor potential when exposed to the same light amount. The information indicating the deteriorated state of the photoreceptor drums 34-1 and 35-1 may be generated by any method. For example, the information may be a deterioration metric calculated or estimated based on the number of times the photoreceptor drums 34-1 and 35-1 have been used in an image formation process, the total exposure time to which each photoreceptor drum 34-1 and 35-1 has been subjected, and/or an age (e.g., the time since installation) of the photoreceptor drums 34-1 and 35-1.

The light amount switching unit 111 acquires sheet information from the sheet information acquisition unit 113. The light amount switching unit 111 also acquires the sheet type/light amount correspondence information recorded in advance in the storage device 103. The sheet type/light amount correspondence information indicates a light amount to be used with different sheet types. For example, the normal light amount is to be used with plain paper, but the dimmed light amount is to be used with thick paper.

The light amount switching unit 111 specifies the light amount setting according to type of sheet based on the sheet type/light amount correspondence information. The light amount switching unit 111 switches the light amount setting for the laser beam output from the light source 50 to the specified light amount setting as necessary.

The light amount switching unit 111 may be configured to switch the light amount setting based on the information indicating the deteriorated state of the photoreceptor drums 34-1 and 35-1 as acquired from the deteriorated state acquisition unit 114. In this case, the light amount switching unit 111 acquires the deteriorated state/light amount correspondence information from the storage device 103. The deteriorated state/light amount correspondence information indicates the light amount to be used according to the deterioration state of the photoreceptor drums 34-1 or 35-1. For example, the normal light amount is to be used with a more deteriorated photoreceptor drum, and the dimmed light amount is to be with a less deteriorated photoreceptor drum. The light amount switching unit 111 specifies the light amount setting according to the deteriorated state of the photoreceptor drums 34-1 and 35-1 based on the acquired deteriorated state/light amount correspondence information. The light amount switching unit 111 switches the light amount setting for the laser beam output from the light source 50 to the specified light amount as necessary.

The timing correction unit 115 acquires the delay amount difference value recorded in the storage device 103 by the delay amount difference calculation unit 112. The timing correction unit 115 performs the control to correct the dotting start timing of dots in the main scanning direction Sc based on the acquired delay amount difference value.

For example, when the dimmed light amount is being used, the timing correction unit 115 corrects the delay in the dotting start timing of dots by the delay amount difference value. The delay amount difference value is, for example, a value such as a number of dots, a number of clock cycles, or a time. On the other hand, when the normal light amount is being used, the timing correction unit 115 may leave the dotting start timing of dots along the main scanning direction Sc unadjusted.

The network interface 102 transmits/receives data to/from another apparatus. The network interface 102 operates as an input interface and receives data transmitted from another apparatus. The network interface 102 also operates as an output interface and transmits data to another apparatus.

The storage device 103 stores various data. For example, the storage device 103 is a hard disk or a solid-state drive (SSD). For example, in this context various data may include digital data, screen data of a setting screen, setting information, a print job, a print job log, or the like. The various data may also include the above-described delay amount difference value, sheet type/light amount correspondence information, deteriorated state/light amount correspondence information, and the like.

The memory 104 temporarily stores the data being used by each functional unit. For example, the memory 104 is a random-access memory (RAM). For example, the memory 104 temporarily stores digital data, print jobs, print job logs, and the like.

The correction control of the deviation in the dotting positions of dots in the main scanning direction Sc caused by the change in the light amount of the laser beam will be described.

The image forming apparatus 100 according to the present embodiment changes the speed of scanning of the laser beam according to the type of sheet on which the image is being formed. For example, when a thick paper is to be used, the speed of scanning by the laser beam is controlled to be slower than that when plain paper is to be used.

In general, the faster the speed of scanning, the shorter the time that the laser beam dwells at the same nominal position, and therefore, it can be necessary to increase the intensity of the laser beam accordingly. Similarly, the slower the speed of scanning, the lower the intensity of the laser beam that can be used. However, delay times for output of the signal from the sensor 58 can also change with laser beam power. Generally, the higher the intensity of the laser beam, the shorter the delay time between when the laser beam enters the sensor 58 to when the sensor 58 outputs the horizontal synchronization signal to the light control circuit 51. On the other hand, the lower the intensity of the laser beam, the longer the delay time between when the laser beam enters the sensor 58 to when the sensor 58 outputs the horizontal synchronization signal to the light control circuit 51.

When delay time is long, the dotting start timing of dots in the main scanning direction Sc is delayed. Furthermore, since the light amount setting of the laser beam can be switched according to changes in the speed of scanning, the dotting positions of dots in the main scanning direction Sc can be further deviated from intended or expected position.

The image forming apparatus 1 according to the embodiment corrects the dotting start timing of dots in the main scanning direction Sc based on the delay amount difference value. The image forming apparatus 1 thus suppresses the occurrence of deviations in the dotting positions of dots in the main scanning direction Sc.

The image forming apparatus 1 according to the present embodiment calculates the delay amount difference value as in the following examples.

Figure 7:
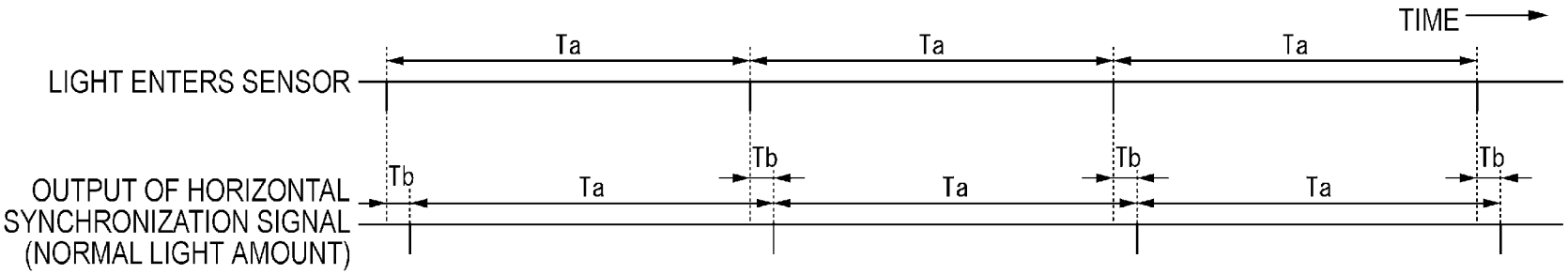
FIGS. 7-9 are diagrams illustrating examples of a calculation process of a delay amount difference value by an image forming apparatus according to an embodiment.
Figure 8:
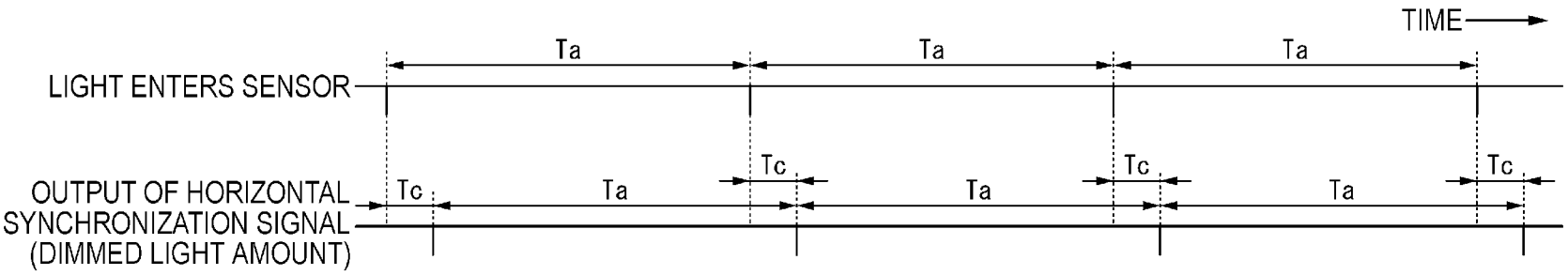
Figure 9:
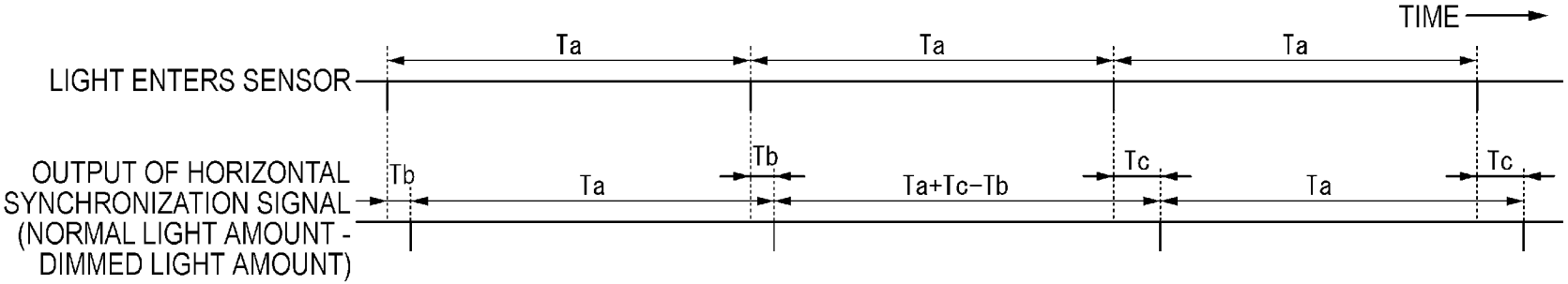

FIGS. 7, 8, and 9 are diagrams illustrating examples of the delay amount difference value calculation process by the image forming apparatus 1. In FIGS. 7 to 9, the horizontal axis represents the time axis.

In FIGS. 7 to 9, the upper horizontal axes indicate the timings at which the laser beam emitted from the light source 50 enters the sensor 58, respectively. As illustrated in each figure, the interval at which the laser beam enters the sensor is an equal interval, which is an interval Ta. The horizontal axis in the lower portions of FIGS. 7 to 9 indicate the timing at which the sensor 58 outputs the horizontal synchronization signal to the light control circuit 51 according to the detection of the laser beam.

FIG. 7 illustrates the case where the light amount of the laser beam is a normal light amount. FIG. 8 illustrates the case where the light amount of the laser beam is a dimmed light amount. As illustrated in FIG. 7, the delay amount (delay interval) from the time when the laser beam enters the sensor to the time when the sensor 58 outputs a horizontal synchronization signal to the light control circuit 51 is a fixed interval Tb. As illustrated by the horizontal axis in the lower portion, since the same delay amount (interval Tb) occurs in each period, the interval at which the horizontal synchronization signal is output from the sensor 58 is still equal to the interval Ta. That is, the interval at which the laser beam enters the sensor 58 and the interval at which the horizontal synchronization signal is output from the sensor 58 are the same, though offset from each other in time.

As illustrated in FIG. 8, the delay amount (delay interval) from the time when the laser beam enters the sensor to the time when the sensor 58 outputs a horizontal synchronization signal to the light control circuit 51 is the fixed interval Tc. The interval Tc is longer than the interval Tb. As illustrated by the horizontal axis in the lower portion of FIG. 8, since the same delay amount (interval Tc) occurs in each period, the timing at which the horizontal synchronization signal is output from the sensor 58 is still equal to the interval Ta, though offset in time.

The image forming apparatus 1 according to the present embodiment calculates the delay amount difference value by switching the light amount from the time when the laser beam enters the sensor 58 to the time when the laser beam enters the sensor 58 again in the next period (next main scanning). In the example illustrated in FIGS. 7 to 9, the delay amount difference value is the value of the interval (Tc−Tb).

FIG. 9 illustrates the case where the normal light amount is switched to the dimmed light from one period to the next (the next main scanning). The interval at which the horizontal synchronization signal is output from the sensor 58, which is illustrated on the horizontal axis in the lower portion, is the interval Ta in a normal light amount period.

However, as illustrated in FIG. 9, the interval at which the horizontal synchronization signal is output from the sensor 58 changes for the next period when the light amount is switched. In this example, the normal light amount is switched to the dimmed light amount after the second period, thus the interval at which the horizontal synchronization signal will be output from the sensor 58 becomes the interval (Ta+Tc−Tb).

The image forming apparatus 1 according to the embodiment can calculate the delay amount difference value (interval (Tc−Tb)) from an interval (for example, the interval Ta) of the output of the horizontal synchronization signal in the normal period and an interval (for example, the interval (Ta+Tc−Tb)) of the output of the horizontal synchronization signal in a period in which the light amount is switched.

As expressed by the Equation (1), when the interval Ta is 200 μsec (microseconds), the interval (Tc−Tb) is 10 nsec (nanoseconds), and the length of the scanning line is 250 mm, the deviation in the dotting positions of dots in the main scanning direction Sc between the case of normal light amount and the case of dimmed light amount is 12.5 μm (microns).

$$[(250\times1000)/(200\times1000)]\times10=12.5 \quad \text{Equation (1):}$$

In such a case, for example, when switching from the normal light amount to the dimmed light amount, the image forming apparatus 1 according to the embodiment corrects the dotting start position for dots along the main scanning direction Sc by 12.5 μm in the main scanning direction Sc.

Hereinafter, an example of the calculation process of the delay amount difference value by the image forming apparatus 1 will be described.

Figure 10:
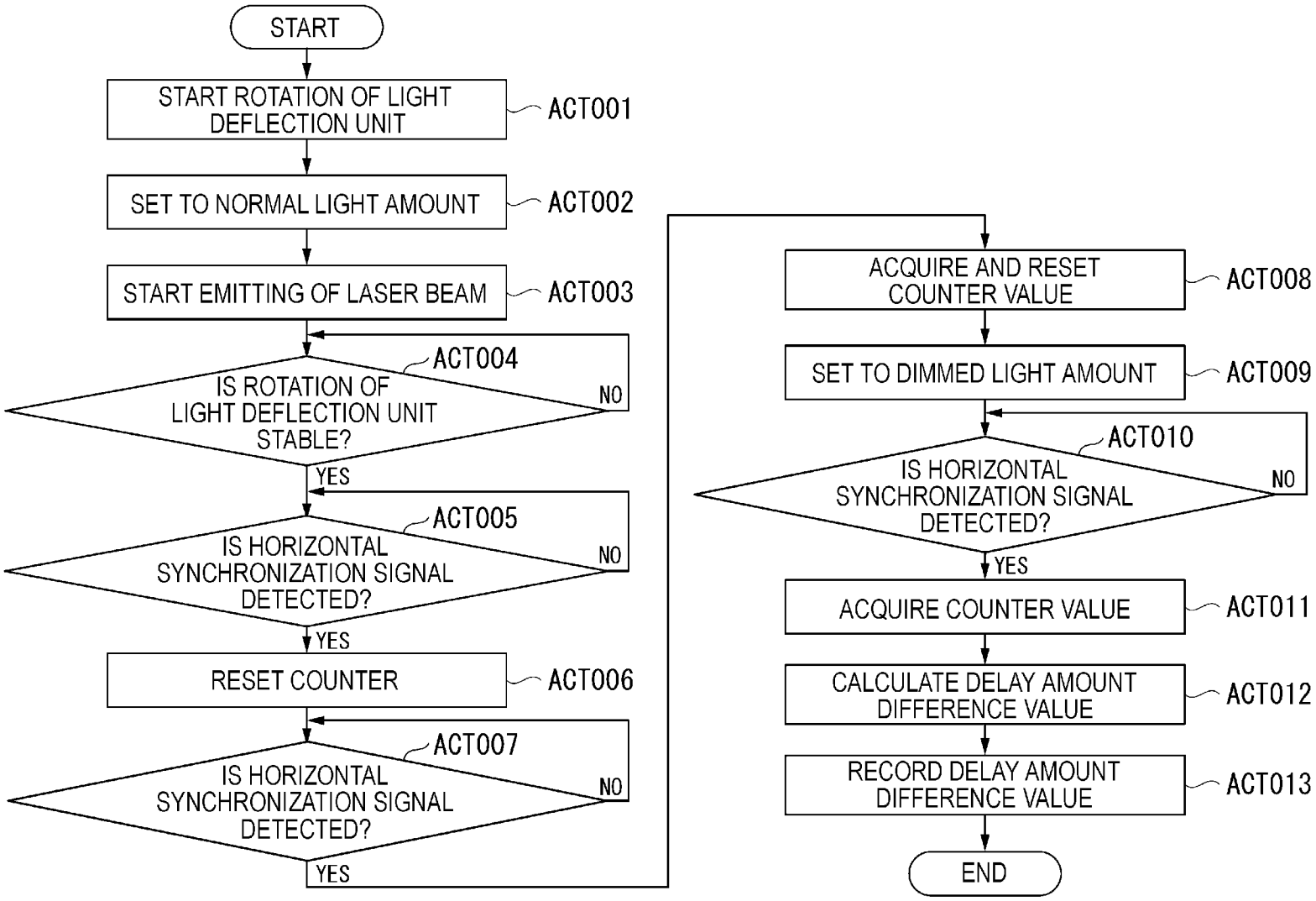
FIG. 10 is a flowchart illustrating a calculation process of the delay amount difference value by an image forming apparatus according to an embodiment.

FIG. 10 is a flowchart illustrating the calculation process of the delay amount difference value by the image forming apparatus 1. The time at which the calculation process of the delay amount difference value is executed is, for example, an initial start-up time, each start-up time, or a time between printing jobs of the image forming apparatus 1.

The control unit 101 starts the rotation of the light deflection unit 52 of the exposing unit 31 (ACT001). Next, the light control circuit 51 sets the light amount of the laser beam emitted from the light source 50 to the normal light amount based on the instruction from the control unit 101 (ACT002). Next, the light control circuit 51 controls the light source 50 and starts emitting the laser beam (ACT003).

Next, the control unit 101 detects whether or not the rotation of the light deflection unit 52 is stable (ACT004). In a case where the control unit 101 detects that the rotation of the light deflection unit 52 is not stable (NO in ACT004), the control unit 101 waits until the rotation becomes stable. When the control unit 101 detects that the rotation of the light deflection unit 52 is stable (YES in ACT004), the control unit 101 controls the light control circuit 51 and starts detection of the horizontal synchronization signal output from the sensor 58. The light control circuit 51 waits for the arrival of the horizontal synchronization signal (ACT005).

When the light control circuit 51 detects the horizontal synchronization signal output from the sensor 58 (YES in ACT005), the control unit 101 resets the counter of the time measuring unit 110 (ACT006). As described above, the counter referred to herein is a counter for the time measuring unit 110 to measure the interval at which the horizontal synchronization signal is input to the light control circuit 51. The light control circuit 51 again waits for the arrival of the horizontal synchronization signal (ACT007).

When light control circuit 51 detects the horizontal synchronization signal output from the sensor 58 (YES in ACT007), the control unit 101 acquires the count value of the counter of the time measuring unit 110 and resets the counter again (ACT006). The count value acquired herein is, for example, a value indicating the interval (interval Ta) of the first period on the horizontal axis in the lower portion of FIG. 9. The time measuring unit 110 outputs the acquired count value to the delay amount difference calculation unit 112.

Next, the light control circuit 51 switches the light amount of the laser beam emitted from the light source 50 to the dimmed light amount based on the instruction from the control unit 101 before the next horizontal synchronization signal is detected (ACT009). Again, the light control circuit 51 waits for the arrival of the horizontal synchronization signal (ACT010).

When the light control circuit 51 detects the horizontal synchronization signal output from the sensor 58 (YES in ACT010), the control unit 101 acquires the count value of the counter of the time measuring unit 110 (ACT011). The count value acquired herein is, for example, a value indicating the interval (interval (Ta+Tc−Tb)) of the second period on the horizontal axis in the lower portion of FIG. 9. The time measuring unit 110 outputs the acquired count value to the delay amount difference calculation unit 112.

Next, the delay amount difference calculation unit 112 calculates the delay amount difference value. For example, the interval (Tc−Tb)) is calculated from the interval in the first period (a period with a length of interval Ta in this example) and the interval in the second period (a period with a length of interval (Ta+Tc−Tb) in this example) (ACT012). Next, the delay amount difference calculation unit 112 records the calculated delay amount difference value in the storage device 103 (ACT013).

The calculation process of the delay amount difference value by the image forming apparatus 1 illustrated in the flowchart of FIG. 10 is thus completed.

In the process illustrated in the flowchart of FIG. 10, the image forming apparatus 1 first sets the normal light amount and then calculates the delay amount difference value by switching to the dimmed light amount. However, the present disclosure is not limited thereto, and the image forming apparatus 1 may first set the dimmed light amount and then calculate the delay amount difference value by switching to the normal light amount.

By the above-described processes, the delay amount difference value is calculated in advance and recorded in the storage device 103 before the printing job (image formation on the sheet) by the image forming apparatus 1. When each printing job is executed, the image forming apparatus 1 reads the delay amount difference value from the storage device 103 according to the light amount setting of the laser beam and corrects the dotting positions of dots in the main scanning direction Sc by the laser beam.

Hereinafter, an example of the correction process of the dotting timing of dots in the main scanning direction Sc by the image forming apparatus 1 will be described. The processes described below are processes performed, for example, when each printing job is executed.

Figure 11:
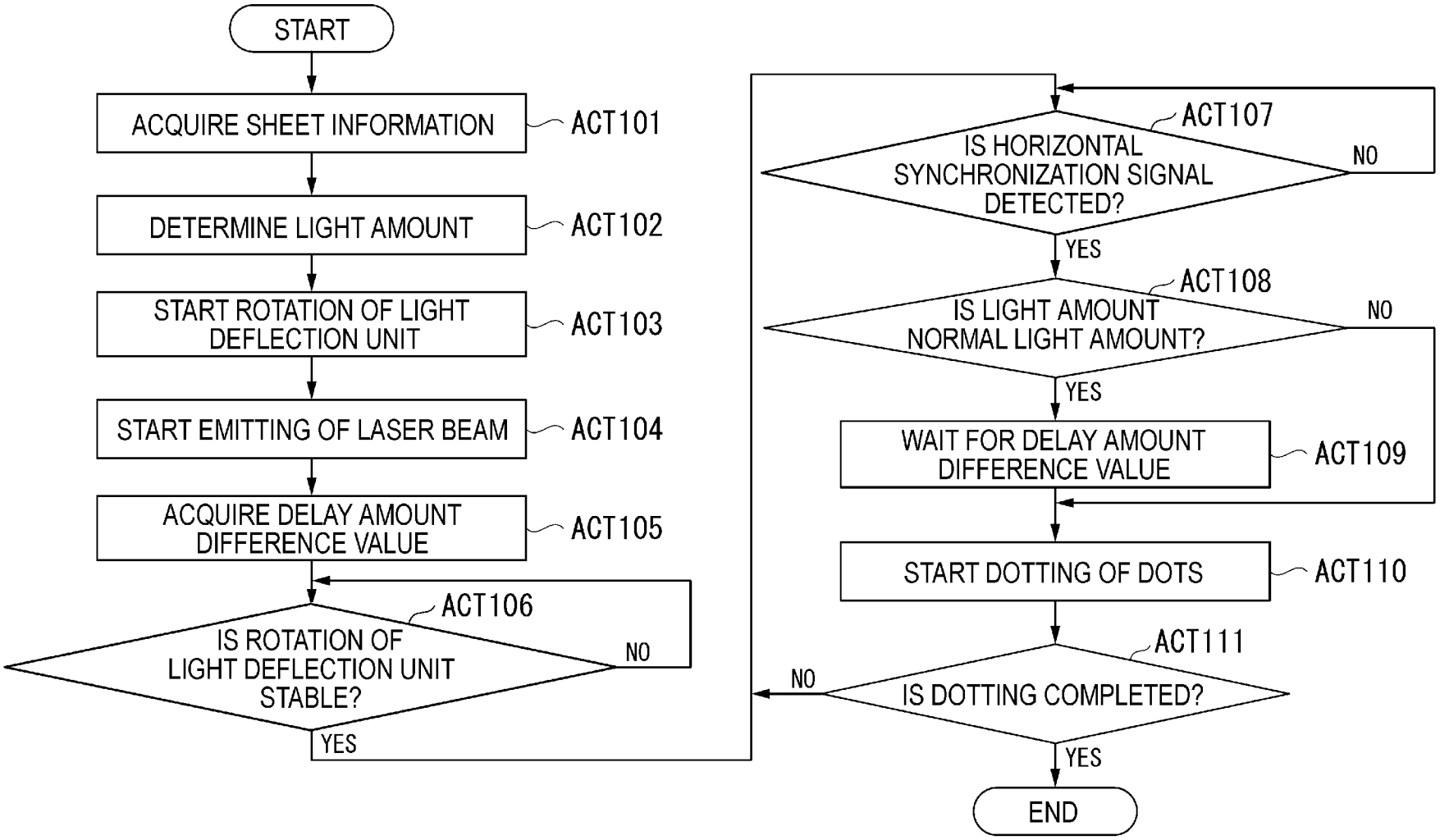
FIG. 11 is a flowchart illustrating a correction process of dot timing along a main scanning direction by an image forming apparatus according to an embodiment.

FIG. 11 is a flowchart illustrating the correction process of the dotting timing of dots in the main scanning direction Sc by the image forming apparatus 1.

The sheet information acquisition unit 113 of the control unit 101 acquires the sheet information (ACT101). As described above, the sheet information is information indicating the type of sheet (such as plain paper or thick paper) to be used in the printing. The sheet information acquisition unit 113 acquires the sheet information generated by, for example, the user performing an operation of selecting the type of sheet by the operation unit 12.

Next, the light amount switching unit 111 acquires sheet information from the sheet information acquisition unit 113. The light amount switching unit 111 also acquires the sheet type/light amount correspondence information recorded in advance in the storage device 103. As described above, the sheet type/light amount correspondence information is information in which the type of sheet and the light amount are stored in correspondence with each other.

The light amount switching unit 111 specifies the light amount setting for the type of sheet indicated by the acquired sheet information by referring to the sheet type/light amount correspondence information. The light amount switching unit 111 sets the light amount for the laser beam output from the light source 50 to the specified light amount setting (ACT102).

In this process, the light amount switching unit 111 is configured to determine the light amount to be used based on the sheet information acquired from the sheet information acquisition unit 113, but the present disclosure is not limited thereto. For example, the light amount switching unit 111 may be configured to determine the light amount to be used based on the information indicating the present deterioration state of the photoreceptor drums 34-1 and 35-1 as acquired from the deteriorated state acquisition unit 114.

In such a case, the light amount switching unit 111 identifies the light amount to be used based on the state of the photoreceptor drums 34-1 and 35-1 as indicated by the acquired information by referring to the deteriorated state/light amount correspondence information recorded in advance in the storage device 103. Then, the light amount switching unit 111 switches the light amount setting to the specified light amount.

Next, the control unit 101 starts the rotation of the light deflection unit 52 of the exposing unit 31 (ACT103). Next, the light control circuit 51 controls the light source 50 and starts emitting the laser beam (ACT104). Next, the timing correction unit 115 of the control unit 101 acquires a delay amount correction value recorded in advance in the storage device 103 (ACT 105). The delay amount correction value acquired herein is, for example, a value calculated by the process illustrated by the flowchart of FIG. 10.

Next, the control unit 101 detects whether or not the rotation of the light deflection unit 52 is stable (ACT106). When the control unit 101 detects that the rotation of the light deflection unit 52 is not stable (NO in ACT106), the control unit 101 waits until the rotation becomes stable. When the control unit 101 detects that the rotation of the light deflection unit 52 is stable (YES in ACT106), the control unit 101 controls the light control circuit 51 and starts detection of the horizontal synchronization signal output from the sensor 58. The light control circuit 51 waits for the arrival of the horizontal synchronization signal (ACT107).

When the light control circuit 51 detects the horizontal synchronization signal output from the sensor 58 (YES in ACT107), the timing correction unit 115 performs correction control of the dotting timing of dots in the main scanning direction Sc based on the light amount setting determined by the light amount switching unit 111 in the process of the ACT 102.

When the light amount setting determined by the light amount switching unit 111 is the normal light amount (YES in ACT108), the timing correction unit 115 waits for a time corresponding to the delay amount difference value (ACT109), and after that, starts the dotting of dots in the main scanning direction Sc by the laser beam (ACT110). If the light amount setting determined by the light amount switching unit 111 is the dimmed light amount (NO in ACT108), the timing correction unit 115 starts the dotting of dots in the main scanning direction Sc by the laser beam without performing the above-described waiting (ACT110).

The control unit 101 repeatedly executes the processes of ACT 107 to ACT 110 until all the dotting of dots by the laser beam is completed (ACT 111). By the above description, the correction process for the dotting timing along the main scanning direction Sc is completed.

As described above, the image forming apparatus 100 according to the present embodiment includes a light source 50, a sensor 58, and a control unit 101. The light source 50 emits a laser beam (light) that is used to scan the scanning area J. The sensor 58 is arranged at a position which is also irradiated with the laser beam. The sensor 58 detects the laser beam emitted at each main scanning. The sensor 58 outputs a horizontal synchronization signal (synchronization signal) that synchronizes the writing positions of dots (pixels) in the main scanning direction Sc according to the detection of the laser beam. The control unit 101 controls the dotting positions (writing positions) of dots in the main scanning direction Sc based on the change in the output interval of the horizontal synchronization signal that can be caused by a change in the light output amount of the laser beam.

With such a configuration, the image forming apparatus 1 can correct the deviation in the writing positions of dots (pixels) in the main scanning direction Sc, which may otherwise be caused due to the change in the light amount setting of the laser beam, based on a delay amount difference value calculated in advance.

According to the image forming apparatus 1 of the present embodiment, even when the light amount of the laser beam is changed according to, for example, the type of sheet and/or the deteriorated state of the photoreceptor drum(s), it is possible to suppress the deviation in the dotting positions of dots in the main scanning direction that might otherwise be caused by the change. Accordingly, the image forming apparatus 1 can prevent the occurrence of deviation in the transfer position of the image on the sheet.

While certain embodiments have been described these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus, comprising:

an exposure unit configured to selectively emit light to positions along a first scan direction to write pixels in accordance with a main scan line of image data;

a light sensor at a position to receive light from the exposure unit and configured to output a synchronization signal according to detection of the light emitted for each main scan line of image data; and a controller configured to adjust a starting pixel position along the first scan direction for a main scan line of image data based on a change in an output interval of the synchronization signal resulting from a change in an intensity of light emitted by the exposure unit, wherein the controller is configured to change the intensity of light emitted by the exposure unit according to a deterioration metric of a photoconductive drum exposed to light from the exposure unit.

2. The image forming apparatus according to claim 1, wherein the controller calculates a correction amount for adjusting the starting pixel position based on a previously measured time difference in the output interval for a change in the intensity of light emitted by the exposure unit at a first setting to a second setting.

3. The image forming apparatus according to claim 2, wherein the controller is configured to adjust the starting pixel position of a main scan line of image data by waiting for a time interval set based on the correction amount before writing the pixels of the main scan line of image data.

4. The image forming apparatus according to claim 2, wherein the controller is configured to change the intensity of light emitted by the exposure unit from the first setting to the second setting based on a user print setting.

5. The image forming apparatus according to claim 1, wherein the controller is configured to:

measure the output interval of the synchronization signal for light emitted by the exposure unit at a first setting;

change the intensity of light emitted by the exposure unit from the first setting to a second setting;

measure the output interval of the synchronization signal for light emitted by the exposure unit at the second setting; and calculate the change in the output interval of the synchronization signal between the first setting and the second setting.

6. The image forming apparatus according to claim 5, further comprising:

a storage device, wherein the controller is configured to store the calculated change in the output interval of the synchronization signal from the first setting to the second setting in the storage device.

7. The image forming apparatus according to claim 1, wherein the controller is configured to estimate the change in the intensity of light emitted by the exposure unit based on the deterioration metric for the exposure unit.

8. The image forming apparatus according to claim 1, wherein the exposure unit includes a laser, a polygonal mirror to reflect the laser, and a motor to rotate the polygonal mirror.

9. The image forming apparatus according to claim 1, wherein the exposure unit selectively emits light onto a photoconductive drum.

10. The image forming apparatus according to claim 1, wherein the controller is configured to change a scanning speed of the exposure unit and the intensity of light emitted by the exposure unit according to the change in scanning speed.

11. The image forming apparatus according to claim 1, wherein the exposure unit comprises:

a light source;

a polygon mirror to reflect light emitted from the light source; and a motor configured to rotate the polygonal mirror at a constant speed and cause light emitted from the light source to scan along the first scan direction to write pixels in accordance with the main scan line of the image data.

12. A printer, comprising:

a light source configured to selectively emit light according to image data;

a photoconductive drum having a photoconductive surface that changes conduction upon exposure to light from the light source;

a polygon mirror configured to reflect light emitted from the light source;

a motor configured to rotate the polygonal mirror and cause light emitted from the light source to scan along a first scan direction of the photoconductive drum to write pixels in accordance with a main scan line of the image data;

a light sensor at a position to receive light reflected from polygonal mirror and configured to output a synchronization signal according to detection of the light emitted for each main scan line of image data; and a controller configured to adjust a starting pixel position along the first scan direction for a main scan line of image data based on a change in an output interval of the synchronization signal resulting from a change in an intensity of light emitted by the light source, wherein the controller is configured to change the intensity of light emitted by the light source based on a deterioration metric for the photoconductive drum.

13. The printer according to claim 12, wherein the controller calculates a correction amount for adjusting the starting pixel position based on a previously measured time difference in the output interval for a change in the intensity of light emitted by the light source occurring with a change of the light source from a first setting level to a second setting level.

14. The printer according to claim 13, wherein the controller is configured to adjust the starting pixel position of a main scan line of image data by waiting for a time interval set based on the correction amount before writing the pixels of the main scan line of image data.

15. The printer according to claim 13, wherein the controller is configured to change the intensity of light emitted by light source based on a user print setting by changing the light source from the first setting level to the second setting.

16. The printer according to claim 12, wherein the controller is configured to:

measure the output interval of the synchronization signal for light emitted by the light source at a first setting;

change the intensity of light emitted by the light source by changing the light source from the first setting to a second setting;

measure the output interval of the synchronization signal for light emitted by the light at the second setting; and calculate the change in the output interval of the synchronization signal between the first setting and the second setting.

17. An image forming apparatus, comprising:

an exposure unit configured to selectively emit light to positions along a first scan direction to write pixels in accordance with a main scan line of image data;

a light sensor at a position to receive light from the exposure unit and configured to output a synchronization signal according to detection of the light emitted for each main scan line of image data; and a controller configured to adjust a starting pixel position along the first scan direction for a main scan line of image data based on a change in an output interval of the synchronization signal resulting from a change in an intensity of light emitted by the exposure unit, wherein the controller is configured to estimate the change in the intensity of light emitted by the exposure unit based on a deterioration metric for the exposure unit.

18. The image forming apparatus according to claim 17, wherein the exposure unit comprises:

a light source;

a polygon mirror to reflect light emitted from the light source; and a motor configured to rotate the polygonal mirror at a constant speed and cause light emitted from the light source to scan along the first scan direction to write pixels in accordance with the main scan line of the image data.

19. An image forming apparatus, comprising:

an exposure unit configured to selectively emit light to positions along a first scan direction to write pixels in accordance with a main scan line of image data;

a light sensor at a position to receive light from the exposure unit and configured to output a synchronization signal according to detection of the light emitted for each main scan line of image data;

a controller configured to adjust a starting pixel position along the first scan direction for a main scan line of image data based on a change in an output interval of the synchronization signal resulting from a change in an intensity of light emitted by the exposure unit; and a storage device, wherein the controller is configured to:

measure the output interval of the synchronization signal for light emitted by the exposure unit at a first setting;

change the intensity of light emitted by the exposure unit from the first setting to a second setting;

measure the output interval of the synchronization signal for light emitted by the exposure unit at the second setting;

calculate the change in the output interval of the synchronization signal between the first setting and the second setting; and store the calculated change in the output interval of the synchronization signal from the first setting to the second setting in the storage device.

20. The image forming apparatus according to claim 19, wherein the exposure unit comprises:

a light source;

a polygon mirror to reflect light emitted from the light source; and a motor configured to rotate the polygonal mirror at a constant speed and cause light emitted from the light source to scan along the first scan direction to write pixels in accordance with the main scan line of the image data.

* * * * *